United States Patent [19]

Hayes et al.

[11] Patent Number: 5,040,507

[45] Date of Patent: Aug. 20, 1991

[54] METHOD AND DEVICE FOR VARIABLE IDLE SPEED CONTROL OF AN INTERNAL COMBUSTION ENGINE

[75] Inventors: Paul A. Hayes; Thomas E. Reinhart, both of Columbus, Ind.

[73] Assignee: Cummins Engine Company, Inc., Columbus, Ind.

[21] Appl. No.: 489,684

[22] Filed: Mar. 7, 1990

[51] Int. Cl.[5] ..... F02D 11/10; F02D 41/16

[52] U.S. Cl. ..... 123/339; 123/342

[58] Field of Search ..... 123/337, 339, 342, 361, 123/399, 400

[56] References Cited

U.S. PATENT DOCUMENTS

| | | | |
|---|---|---|---|
| 4,354,466 | 10/1982 | Dudley et al. | 123/339 |
| 4,391,255 | 7/1983 | Staerzl | 123/481 |
| 4,463,721 | 8/1984 | Hayashi et al. | 123/378 |
| 4,474,083 | 10/1984 | Braun | 123/342 X |
| 4,509,488 | 4/1985 | Forster et al. | 123/481 |
| 4,519,344 | 5/1985 | Ohyama et al. | 123/55 VF |
| 4,530,326 | 7/1985 | Mann et al. | 123/342 |
| 4,552,114 | 11/1985 | Sano et al. | 123/481 |
| 4,608,952 | 9/1986 | Morita et al. | 123/198 F |
| 4,640,241 | 2/1987 | Matsunaga | 123/198 F |
| 4,708,108 | 11/1987 | Sakamoto et al. | 123/339 |
| 4,790,276 | 12/1988 | Sasaki | 123/339 |
| 4,794,893 | 1/1989 | Masuda et al. | 123/90.17 |
| 4,838,225 | 6/1989 | Steffes | 123/342 |
| 4,879,982 | 11/1989 | Itakura et al. | 123/339 |
| 4,886,025 | 12/1989 | Bonfiglioli et al. | 123/339 |

*Primary Examiner*—Willis R. Wolfe

*Attorney, Agent, or Firm*—Woodard, Emhardt, Naughton, Moriarty & McNett

[57] ABSTRACT

A method and device for providing a time-varying minimum engine speed setting are disclosed. A first embodiment of the device includes programming within an electronic engine control module for variably supplying fuel to an engine via variable activation periods for the fuel injectors of a fuel injected engine. In another embodiment a rotating cam provides a positionally time-varying mechanism stop against which the throttle linkage is positioned when released by the operator. In another embodiment of the invention, a solenoid provides a minimum engine speed setting which varies between two different positions. The two different positions are produced by a solenoid, which is activated and deactivated at random to produce a pseudorandom variation in minimum engine speed. Pulse-width activation of the solenoid provides variable positioning of the solenoid actuator between the two end stop positions of the solenoid actuator.

18 Claims, 1 Drawing Sheet

METHOD AND DEVICE FOR VARIABLE IDLE SPEED CONTROL OF AN INTERNAL COMBUSTION ENGINE

BACKGROUND OF THE INVENTION

Field of the Invention

This invention relates to internal combustion engines and more specifically to devices and methods for altering the acoustic signature of such engines.

Deception plays an important role in creating an advantage over opposing military forces. Even ancient military strategists were aware that deception is an integral component of war. A well known component of military deception includes a wide variety of camouflage techniques. The term "camouflage" originated from the French word "camoufler" meaning to disguise or play a trick. The "trick" is to fool the enemy into believing, seeing, or detecting that which you desire to be known. Some camouflage techniques used in the past include: deceive the enemy into believing that he sees no enemy forces or equipment; use fake tanks or aircraft mock-ups to create the illusion that more forces are present than actually exist or to create fake targets for enemy fire; and make identification of military equipment likely to be artillery targets more difficult by use of specially designed paint schemes intended to mask the presence of the target or make identification of specific portions of the target more difficult.

A major concern of military operations in the field is the acoustic detection of their fighting vehicles. Engine exhaust noise is the dominant source of noise under idle conditions. Tread noise dominates when vehicles (e.g. tanks) are in motion. The low frequency exhaust pulses of an idling engine are particularly easy to recognize with a simple spectrum analyzer and a microphone. Alterations of military vehicle acoustic signatures is analogous to stealth technology. The primary objective of both technologies is to evade enemy detection by altering or suppressing the detected radar or acoustic signature of a military fighting craft.

The periodic nature of engine exhaust noise at idle results in an audio frequency spectrum dominated by the firing frequency harmonic. All internal combustion engines, particularly Otto and Diesel cycle engines, will have a characteristic periodic exhaust noise which includes the firing frequency harmonic and higher order harmonics resulting from a number of engine parameters. Design parameters such as exhaust tubing diameter, cylinder dimensions and displacement, exhaust valve design, muffler dynamics and others influence the characteristic exhaust noise emanating from a vehicle. As is well known in the art, for every two revolutions of the crankshaft of an Otto or Diesel cycle engine, a firing cycle is completed. Thus, an engine idling at 480 RPM will repeat a particular firing pattern and produce a repeatable "noise signature" four times a second.

A device and method for altering the acoustic signature of an internal combustion is shown for example in copending application Ser. No. 489,528, by P. Hayes, T. Reinhart and T. Shaw filed concurrently herewith, titled "Device and Method for Altering the Acoustic Signature of an Internal Combustion Engine", the disclosure of which is hereby incorporated by reference. However, the cylinder cutout techniques of the related application can be costly to implement on existing engines.

A periodic exhaust pulse from an Otto or Diesel engine is particularly recognizable with a simple spectrum analyzer and a microphone. A device and method for altering the acoustic noise signature at idle of new and existing engines is needed to prevent acoustic identification of military vehicles under military conflict conditions.

SUMMARY OF THE INVENTION

A method and device for acoustically altering the noise signature of an internal combustion engine according to the present invention are disclosed.

According to one aspect of the invention, a device for varying idle speed and acoustically altering the noise signature of an internal combustion engine comprises means connected to the engine for controlling engine speed, and means for establishing a time-varying minimum speed setting of said means for controlling engine speed.

According to another aspect of the invention, a device for altering the idle speed noise signature of an Otto or Diesel cycle engine comprises first circuit means for sensing engine speed and producing an RPM signal proportional to engine speed, second circuit means for producing a power demand signal proportional to the position of an engine power request mechanism, third circuit means responsive to the RPM signal and the power demand signal for producing a fuel signal corresponding to the power demand signal, the fuel signal having a time-varying signal superimposed thereon when the RPM signal is below a predetermined RPM and the power demand signal is below a predetermined power limit, and means responsive to the fuel signal for supplying fuel to the engine in proportion to the amplitude of the fuel signal.

In accordance with a further aspect of the invention, a device for providing a time-varying minimum engine speed setting for an Otto or Diesel engine including a throttle linkage, the device comprises throttle position servo means for establishing a minimum engine speed setting and circuit means for supplying a position signal to the throttle position servo means wherein the throttle position servo means responds to the position signal by providing a minimum speed setting for the throttle linkage in accordance with the position signal between a predetermined upper and lower speed limit.

According to another aspect of the invention, a method for altering the acoustic noise signature of an internal combustion engine comprises the steps of detecting a low-load state of operation of the engine, and altering the idle speed setting of the engine in a time-varying fashion in response to detecting the low-load state of operation.

In accordance with yet another aspect of the invention, a method for altering the acoustic noise signature of an internal combustion engine comprises the step of providing a time-varying minimum engine speed setting for the engine.

One object of the present invention is to alter the characteristic idle speed exhaust noise of an internal combustion engine.

Another object of the present invention is to provide a time-varying alteration of the exhaust noise emanating from an internal combustion engine thereby preventing acoustic signature identification of the engine.

These and other objects of the present invention will become apparent from the following description of the preferred embodiment.

DESCRIPTION OF THE PREFERRED EMBODIMENT

Figure 1:
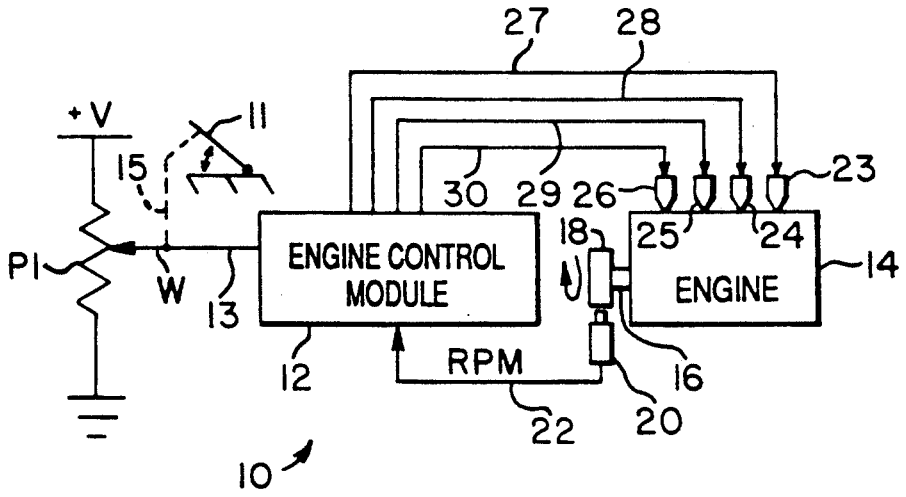
FIG. 1 is a diagrammatic illustration of an internal combustion engine including a fuel injection system controlled by an engine control module.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, a diagrammatic illustration of a device 10 compatable with the teachings of the present invention for providing a time-varying minimum engine speed setting is shown. Engine control module (ECM) 12 includes a microcomputer with programming, I/0 interface circuitry and analog and digital I/0 designed for control of a multi-cylinder electronic fuel injection system. Fuel injectors 23–26 are controlled and actuated by ECM 12 via control lines 27–30, respectively. Sensor 20 provides a signal, via signal path 22, indicative of engine RPM to an input interface circuit contained within ECM 12. Sensor 20 produces signals corresponding to detection of gear teeth located on the circumference of flywheel 18 or magnets (magnetic sensing) attached or mounted near the perimeter of flywheel 18. Signals typically produced by magnetic or Hall effect sensors commonly used for sensor 20 are well known in the electronic engine control art. Flywheel 18 is mounted on the crankshaft 16 of engine 14. Fuel injectors 23–26 are mounted on engine 14 in appropriate locations for injecting fuel into the cylinders (not shown) of engine 14. A pressurized fuel supply source (not shown) provides engine fuel to injectors 23–26.

Operationally speaking, ECM 12 senses engine speed via pulse signals from sensor 20. Sensor 20 is an electromagnetic sensor or optical sensor which produces signals indicative of the speed of rotation of flywheel 18. ECM 12 receives the signals produced by sensor 20 at an input and mathematically determines engine speed from the signals present on signal path 22. Engine power demand, or speed requested, is determined by the position of wiper W, a component of potentiometer P1. The position of wiper W is controlled by a mechanical link 15 and corresponds to the position of accelerator pedal or lever 11. The analog voltage present on wiper W is supplied, via signal path 13, to ECM 12. When ECM 12 determines, by the voltage present on signal path 13 falling below a predetermined limit, that the operator has positioned lever 11 thereby requesting a minimum speed or low-load operating state for engine 14, ECM 12 responds by monitoring the RPM of the engine via sensor 20 and providing actuation signals via signal paths 27–30 to fuel injectors 23–26 to vary the amount of fuel supplied to engine 14. By varying the duration of the actuation signals supplied to the fuel injectors 23–26, ECM 12 varies the fuel delivered and thus the engine speed according to a predetermined time-varying programming algorithm. The algorithm includes a means for varying the idle speed setting of the engine by varying the pulse-width of the actuation signals supplied to fuel injectors 23–26. Variations in the duration of the actuation signals in a periodic or aperiodic fashion result in the engine 14 idling at a time-varying speed. By programmatically varying the idle speed of engine 14, the frequency spectrum associated with the exhaust noise pulses will more closely resemble broad band noise over an extended period of time versus the concentration of spectral energy in the frequency harmonics of the exhaust noise pulse for a constant idle speed condition. Thus, ECM 12 provides a means for establishing a time-varying minimum engine speed or idle speed setting according to the ECM algorithm.

As is well known in the art of internal combustion engines, an even firing engine, or one that fires at equiangular positions with regard to crankshaft rotation, produces an exhaust noise in the form of exhaust pulses at regular timed internals. By introducing variable time spans between exhaust noise pulses as a result of variations in idle speed, the ECM 12 programmatically in a time-varying fashion varies or alters the acoustic signature of engine 14.

The descriptive phrase "time-varying" includes any possible programmable algorithm which provides an idle speed setting that changes rapidly, as often as every hundredth of a second in some applications or program algorithms. The time-varying idle speed setting is implemented by the microcomputer of the ECM 12 programmatically and may include variable engine RPM speed slopes, speed settings that are fixed for a brief period such as a tenth to five-tenths of a second, continuously varying idle speed settings and other methods suitable to produce alteration of the acoustic signature of the engine. The object of the invention is to modify or vary the time span between exhaust pulses in order to make it difficult or impossible to use a microphone and spectrum analyzer to produce a frequency spectrum of the acoustic harmonics for comparison with an acoustic signature previously known and documented for a particular vehicle having a known engine.

Time-varying minimum engine speed setting operation of a fuel injection system requires varying the width of actuation pulses to the fuel injectors such that the speed of the engine over a period of time, such as 0.1 to 0.5 seconds, is not continuous or steady-state in nature. By achieving the objective of a time-varying minimum engine speed, the device 10 according to the present invention can successfully elude acoustic discovery via acoustic signature identification techniques.

Figure 2:
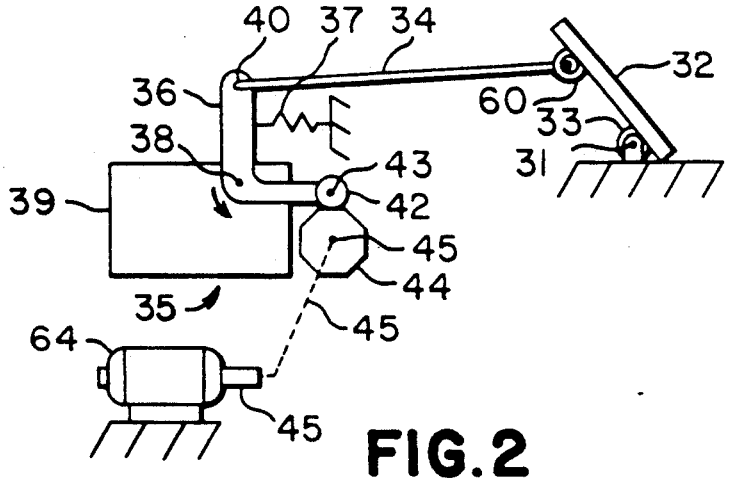
FIG. 2 is a diagrammatic illustration of a device according to the present invention including a servo mechanism for varying the minimum speed setting of an engine.

Referring now to FIG. 2, an alternate embodiment of a device for providing a time-varying minimum engine speed setting for an internal combustion engine is shown. Device 35 includes accelerator pedal or lever 32 pivotally mounted to pin 31 via mounting adaptor 33. At the free-moving end of accelerator pedal 32, throttle linkage 34 pivotally connects to accelerator pedal 32 via adaptor 60. The opposite end of throttle linkage 34 is pivotally connected to throttle control arm 36 at location 40. Throttle control arm 36 is mounted on throttle shaft 38. Fuel metering device 39 is a carburetor or, in the alternative, a fuel valve for controlling or varying the rate of fuel flow to a fuel injection system. Throttle shaft 38 extends into device 39 to control the speed of an engine (not shown) by variably metering fuel to fuel injectors or, if device 39 is a carburetor, to an intake manifold of an engine. Cam follower 42 is pivotally attached to throttle control arm 36 via pin 43. Located adjacent to cam follower 42 is cam 44 which rotates about motor shaft 45. Cam 44 is rotated by DC motor 64 diagrammatically shown coupled to cam 44 via broken line 45 representing a portion of motor shaft 45.

Operationally speaking, cam 44 provides a means for establishing a time-varying minimum engine speed setting for throttle control arm 36. As cam 44 rotates cam follower 42 is displaced vertically thereby varying the minimum engine speed setting for throttle control arm 36. Spring 37 exerts a force on control arm 36 to return the control arm to a minimum engine speed position wherein the cam follower contacts the cam. The minimum engine speed setting or position is defined by the cam 44. When an operator depresses or repositions accelerator pedal 32 and rotates throttle shaft 38 via the throttle linkage 34 and arm 36, cam follower 42 is removed from the position wherein it contacts cam 44, and the engine runs at an increased speed determined according to the angular position of shaft 38 and control arm 36. When the operator releases accelerator pedal 32, spring 37 returns throttle control arm 36 and shaft 38 to a minimum speed position determined according to the position of cam follower 42 in contact with cam 44. Cam 44 rotates at a speed determined by the rotation of the shaft of motor 64. Thus, it can be seen that when the engine is in a low-load state or at minimum engine speed condition, cam 44 provides a time-varying minimum engine speed setting for throttle shaft 38. Variations in the profile of cam 44 coupled with variations in rotational speed of motor 64 provide a near random minimum throttle position for throttle shaft 38. Cams providing sinusoidal, linear ramp, saw-tooth or acceleration functions via cam profiles coupled with random variable speed control of motor 64 results in increased variety or increased randomization for the minimum speed or idle setting of throttle shaft 38.

Figure 3:
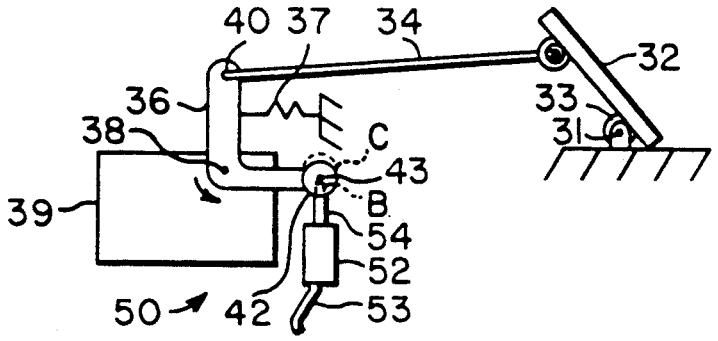
FIG. 3 is a diagrammatic illustration of another device according to the present invention for varying the minimum speed setting of an internal combustion engine.

Referring now to FIG. 3, an alternate embodiment of the time-varying minimum speed setting device of FIG. 2 is shown. In the embodiment of device 50, as compared to device 35, cam 44 is replaced by solenoid 52 which includes solenoid actuator 54 and control cable 53. As in the embodiment of FIG. 2, accelerator pedal 32 pivots about mounting pin 31 via mounting adaptor 33. Accelerator pedal 32 is pivotally connected to throttle control linkage 34. Throttle control linkage 34 is pivotally connected to one end of throttle control arm 36 at location 40. Location 40 typically is a hole in control arm 36 through which throttle linkage 34 is inserted and secured with a cotter pin or clip. Throttle control arm 36 is fixedly mounted to throttle control shaft 38 and both rotate on the axis of shaft 38. Spring 37 provides a spring return force to throttle control arm 36 to return the throttle shaft 38, coupled to fuel metering device 39, to minimum engine speed setting when accelerator pedal 32 is released by an operator, thus indicating a request for minimum engine speed.

Solenoid 52 is an actuator for providing one of two fixed minimum engine speed settings. Solenoid 52 provides a means for establishing a time-varying minimum engine speed setting. In a first position, cam follower 42 is positioned as shown in the figure. When solenoid 52 is actuated, i.e. a power signal is supplied to the solenoid via cable 53, actuator 54 moves cam follower 42 to the position defined by the broken line C, and solenoid actuator 54 occupies a new location defined by the broken line B. Thus, two different fixed minimum speed settings are provided by solenoid 52. Fuel metering device 39, which is controlled via the rotational position of throttle shaft 38, varies the supply of fuel to an engine (not shown) according to the activation and deactivation timing of solenoid 52. Since an internal combustion engine will not instantly change speed, providing a lower and an upper minimum RPM setting and in a time-varying manner changing back and forth between those two settings provides a minimum speed setting which can be varied in a near random fashion by a circuit which provides a random pulse width or time-varying signal to activate solenoid 52. An alternate actuation signal includes pulse-width modulated signals, such as those used to partially open or close solenoid valves, supplied to solenoid 52 to produce variable linear motion forces on solenoid actuator 54. The frequency and duty cycle of actuation signals supplied to solenoid 52 result in time-varying magnetic forces acting upon actuator 54. Actuation signals supplied to solenoid 52 can be of a short enough duration to partially move follower 43 vertically without reaching the upper movement limit B of actuator 54, thereby creating intermediate minimum engine speed positions. Solenoid 52 is randomly or periodically activated for as little as a fraction of a second and as much as several seconds to produce a time-varying minimum engine speed setting.

Various electromechanical actuator devices can be substituted for the motor cam combination of FIG. 2 and the solenoid of FIG. 3. In particular, stepping solenoids coupled to cams, linear actuators, and even a cam-driven mechanism which derives its rotational speed from the speed of the engine provide a suitable means for providing a time-varying minimum engine speed setting. Any internal combustion engine which includes a mechanical linkage coupled to a device for controlling engine speed, such as fuel metering device, can have its acoustic signature altered via a time-varying mechanism or means for establishing a time-varying minimum engine speed setting. Further, motor drive circuitry (not shown) which produces a time-varying power signal supplied to motor 64 of FIG. 2 and a linear ramp-up ramp-down velocity profile cam provides a means for producing a time-varying minimum engine speed setting.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A device for varying idle speed and acoustically altering the noise signature of an internal combustion engine comprising:

means connected to the engine for controlling engine speed; and means for establishing a time-varying minimum speed setting independent of operating conditions or parameters of the engine for said means for controlling engine speed.

2. The device of claim 1 wherein said means for controlling engine speed is a throttle linkage and wherein said means for establishing is an actuator adapted to establish a time-varying minimum engine speed setting for said throttle linkage.

3. A device for varying idle speed and acoustically altering the noise signature of an internal combustion engine comprising:

means connected to the engine for controlling engine speed, said means for controlling engine speed including a throttle linkage;

means for establishing a time-varying minimum speed setting of said means for controlling engine speed, said means for establishing including an actuator, said actuator including a first circuit means for supplying a time-varying actuation signal at an output, said actuator further including a solenoid adapted to be mounted near said throttle linkage, said solenoid providing said time-varying minimum engine speed position setting in response to said time-varying actuation signal.

4. A device for varying idle speed and acoustically altering the noise signature of an internal combustion engine comprising:

means connected to the engine for controlling engine speed, said means for controlling engine speed including a throttle linkage;

means for establishing a time-varying minimum speed setting of said means for controlling engine speed, said means for establishing including an actuator, said actuator including a motor having a cam mounted on an output shaft of said motor, said motor continuously rotating said cam to provide said time-varying minimum engine speed setting for said throttle linkage.

5. The device of claim 2 wherein said means for controlling engine speed is a fuel valve means responsive to the position of said throttle linkage for metering the supply of fuel to said engine.

6. A device for altering the idle speed noise signature of an Otto or Diesel cycle engine comprising:

first circuit means for sensing engine speed and producing an RPM signal proportional to engine speed;

second circuit means for producing a power demand signal proportional to the position of an engine power request mechanism;

third circuit means responsive to said RPM signal and said power demand signal for producing a fuel signal corresponding to said power demand signal, said fuel signal having a time-varying signal superimposed thereon when said RPM signal is below a predetermined RPM and said power demand signal is below a predetermined power limit; and means responsive to said fuel signal for supplying fuel to said engine in proportion to the amplitude of said fuel signal.

7. The device of claim 6 wherein said first, second, and third circuit means are components of an engine control module and said means responsive to said fuel signal includes a plurality of fuel injectors.

8. The device of claim 6 wherein said means responsive to said fuel signal includes a throttle body fuel injection system.

9. A device for providing a time-varying minimum engine speed setting for an Otto or Diesel engine including a throttle linkage, said device comprising:

throttle position servo means for establishing a minimum engine speed setting; and circuit means for supplying a position signal independent of operating conditions or parameters of the engine to said throttle position servo means wherein said throttle position servo means responds to said position signal by providing a minimum speed setting for said throttle linkage in accordance with said position signal between a predetermined upper and lower speed limit.

10. A device for providing a time-varying minimum engine speed setting for an Otto or Diesel engine including a throttle linkage, said device comprising:

throttle position servo means for establishing a minimum engine speed setting said throttle position servo means including an electric motor and a cam mounted on the shaft of the motor; and circuit means for supplying a position signal to said throttle position servo means wherein said throttle position servo means responds to said position signal by providing a minimum speed setting for said throttle linkage in accordance with said position signal between a predetermined upper and lower speed limit.

11. The device of claim 9 wherein said throttle position servo means is an electromechanical solenoid.

12. The device of claim 11 wherein said position signal is a pulse-width modulated signal having time-varying duty cycle characteristics.

13. A method for altering the acoustic noise signature of an internal combustion engine comprising the step of:

providing a means connected to the engine for controlling engine speed;

providing a time-varying minimum engine speed setting for the engine wherein said speed setting is established independent of engine operating conditions or operating parameters of the engine.

14. The method of claim 13 wherein said time-varying minimum engine speed setting is established and controlled by an engine control module including programming for continuously varying engine speed in response to detection of a low-load, low-speed condition.

15. The method of claim 13 wherein said engine includes a throttle linkage and wherein said time-varying minimum engine speed setting is a established by a moving mechanical member adapted to establish a mechanical movement end stop for said throttle linkage, said moving mechanical member having a time-varying position for providing said throttle linkage with a time-varying minimum speed setting.

16. A method for altering the acoustic noise signature of an internal combustion engine comprising the steps of:

detecting a low-load state of operation of said engine; and altering the idle speed setting of said engine independent of operating conditions or parameters of the engine and in a time-varying fashion in response to detecting said low-load state of operation.

17. The method of claim 16 wherein said detecting a low-load state step includes sensing RPM of said engine.

18. The method of claim 16 wherein said engine includes an electronic engine control module, said engine control module including means for sensing engine RPM, means for sensing power demand requests and time-varying idle means for providing a time-varying idle speed setting for said engine when said engine RPM is below a predetermined RPM and said power level request is below a predetermined power level.

* * * * *